United States Patent [19]

Anschutz

[11] Patent Number: 4,505,614

[45] Date of Patent: Mar. 19, 1985

[54] CAM ARM CENTRALIZER

[75] Inventor: Reynold G. Anschutz, Middletown, Ohio

[73] Assignee: Armco Inc., Middletown, Ohio

[21] Appl. No.: 434,474

[22] Filed: Oct. 15, 1982

[51] Int. Cl.[3] ..... E02B 17/00; F16C 29/00

[52] U.S. Cl. ..... 405/195; 175/220; 308/4 A

[58] Field of Search ..... 405/195, 196, 198, 199, 405/228; 166/75 R, 367, 368; 175/220; 254/29 R; 308/3.9, 4 A

[56] References Cited

U.S. PATENT DOCUMENTS

| | | | |
|---|---|---|---|
| 920,548 | 5/1909 | Decker . | |
| 2,631,822 | 3/1953 | Usery | 255/19 |
| 2,661,189 | 12/1953 | Gillerstrom | 255/51 |
| 2,906,799 | 9/1959 | Schlienger | 13/17 |
| 2,941,598 | 6/1960 | Jackson | 254/29 R X |
| 3,142,343 | 7/1964 | Otteman et al. | 175/7 |
| 3,163,221 | 12/1964 | Shatto | 166/368 |
| 3,206,259 | 9/1965 | Curtis | 308/3.9 |
| 3,313,358 | 4/1967 | Postlewaite et al. | 175/7 |
| 3,334,606 | 8/1967 | Deal, Jr. et al. | 114/0.5 |
| 3,528,497 | 9/1970 | Lehman | 166/0.5 |
| 3,834,668 | 9/1974 | Casey | 254/29 R |
| 3,884,298 | 5/1975 | Watkins | 166/0.5 |
| 3,952,384 | 4/1976 | Goldry et al. | 254/29 R X |
| 3,998,428 | 12/1976 | Miles | 254/29 R |
| 4,053,022 | 10/1977 | Mercier | 175/5 |
| 4,076,337 | 2/1978 | Childress | 175/220 X |
| 4,270,877 | 6/1981 | Post | 405/195 X |
| 4,326,756 | 4/1982 | Moroz et al. | 308/3.9 |

*Primary Examiner*—David H. Corbin

*Attorney, Agent, or Firm*—Roylance, Abrams, Berdo & Goodman

[57] ABSTRACT

A centralizer for centering a marine riser in an opening in a working deck. The assembly comprises a plurality of cam arm units pivotally coupled to a portion of the working deck for pivotal movement about pivot axes parallel to the top planar surface of the deck and a plurality of hydraulic power devices for pivoting the cam arm units from a retracted position spaced away from the riser to an active position engaging the riser. Each cam arm unit includes a camming surface which increases in radius from the pivot axis thereof from a first end towards a second end, this second end engaging the riser when each unit is in the active position. Each camming surface is defined by surfaces of a plurality of rollers, two of which are located at the largest radii second end and have the same radii from the pivot axis.

13 Claims, 4 Drawing Figures

BEST AVAILABLE COPY

CAM ARM CENTRALIZER

FIELD OF THE INVENTION

The invention relates to a centralizer assembly for centering a marine riser in an opening in one or more of the working decks of the surface vessel. The assembly includes a plurality of hydraulically actuated cam arm units which are pivotally supported on the deck and can be pivoted about axes parallel to the plane containing the top surface of the deck into engagement with the riser.

BACKGROUND OF THE INVENTION

In subsea drilling operations using a surface vessel, it is highly desirable to keep the vertical axis of the drilling pipe or riser, at a working deck elevation, in line with the vertical axis of the rotary table. This is usually accomplished by providing an opening in the working deck and the use of a centralizer for centering the riser in the opening.

Examples of prior art devices disclosing such centralizers and related equipment are found in the following U.S. Pat. Nos. 920,548 to Decker; 2,631,822 to Ussery; 2,661,189 to Gillerstrom; 2,906,799 to Schlienger; 3,053,022 to Mercier; 3,142,343 to Otteman; 3,206,259 to Curtis; 3,313,358 to Postlewaite et al; 3,334,606 to Deal; and 3,884,298 to Watkins.

Unfortunately, these prior art assemblies have numerous disadvantages such as being complicated and costly to manufacture. In addition, they cannot be easily assembled and disassembled for relocation at subsequent well locations. Thus, there is a continuing need for improvement in such centralizers.

SUMMARY OF THE INVENTION

Accordingly, a primary object of the invention is to provide an improved centralizer for centering a pipe such as a marine riser in an opening in a support such as a working deck.

Another object of the invention is to provide such a centralizer that is simple to manufacture and use and relatively inexpensive.

Another object of the invention is to provide such a centralizer that is easy to assemble and disassemble for relocation at subsequent well locations.

A further object of the invention is to provide such a centralizer having a plurality of cam arm units that are pivotally coupled to a working deck for pivotal movement from a retracted position spaced away from the riser to an active position engaging the riser.

The foregoing objects are basically attained by providing such a centralizer assembly for centering a pipe in an opening in a support, the combination comprising: a plurality of support blocks equally spaced around the opening and rigidly coupled to the top surface of the support; a plurality of cam units, each pivotally coupled to one of the support blocks for pivotal movement about a pivot axis parallel to the plane containing the top surface of the support, each of the cam units including a camming surface facing radially inwardly towards the longitudinal axis of the opening for engaging the pipe, the camming surface increasing in radius from the pivot axis from a first end towards a second end; and power assemblies, coupled to each of the support blocks and cam units, for pivoting each of the cam units from a retracted position spaced away from the pipe located in the opening to an active position wherein the larger radii second end of the camming surface engages the pipe.

Advantageously, the camming surface is formed by the surfaces of a plurality of rollers rotationally coupled to the cam units. In a preferred embodiment, there are four rollers in each cam unit, two of which are located at the largest radii second end and have the same radii from the pivot axis associated therewith, these two rollers engaging the riser in the active position.

Other objects, advantages and salient features of the invention will become apparent from the following detailed description which, taken in conjunction with the annexed drawings, discloses a preferred embodiment of the invention.

DRAWINGS

Referring now to the drawings which form a part of this original disclosure:

DETAILED DESCRIPTION OF THE INVENTION

Figure 1:
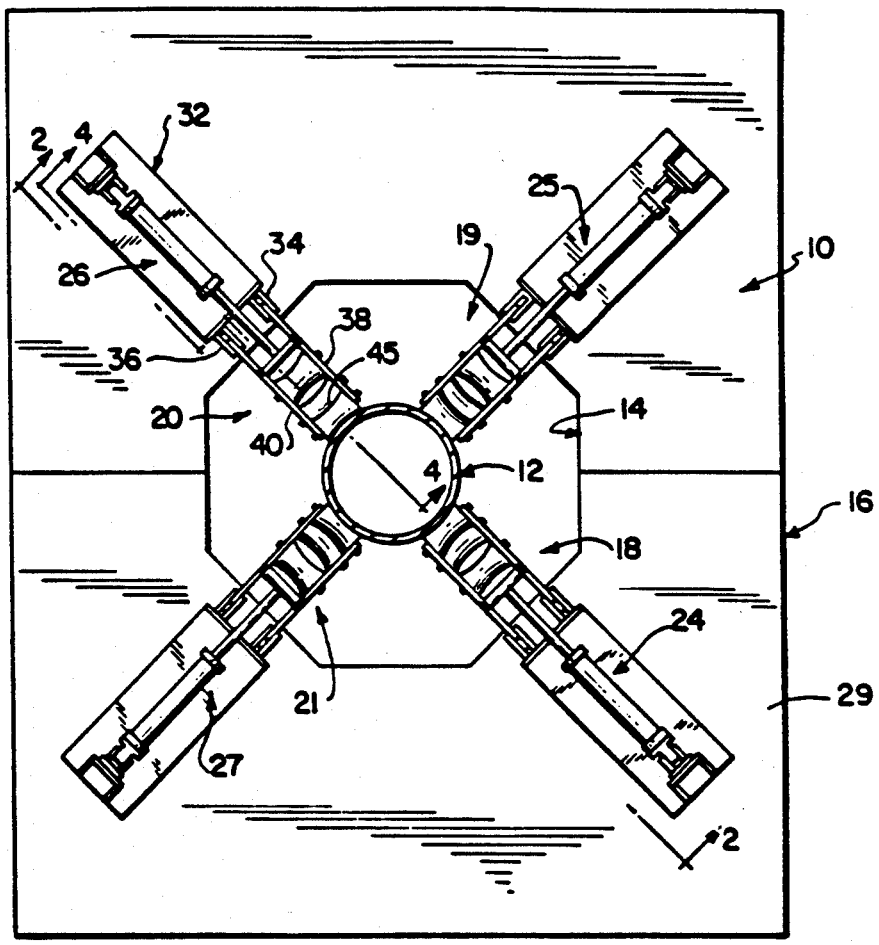
FIG. 1 is a top plan view of the cam arm centralizer in accordance with the invention with the cam arm units located in their active position.
Figure 2:
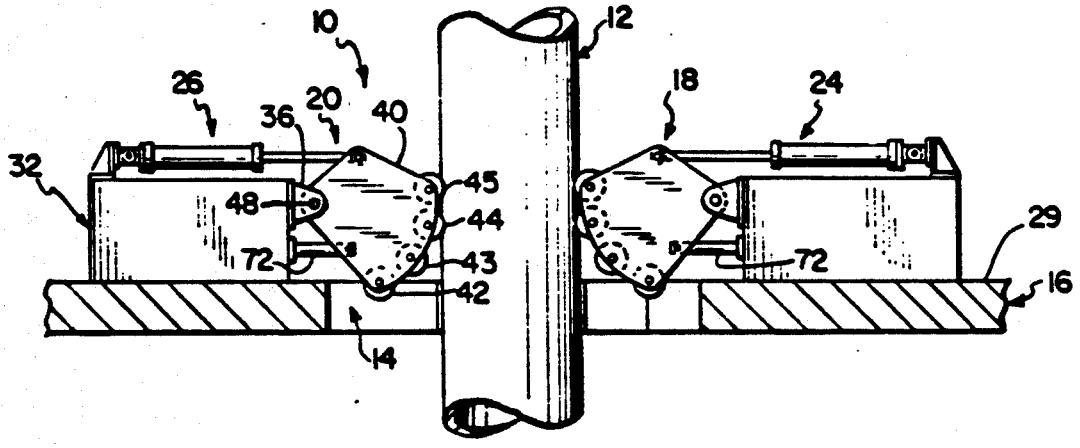
FIG. 2 is a side elevational view in section taken along line 2—2 in FIG. 1 showing the cam arm units in their active position.

As seen in FIGS. 1 and 2, the centralizer 10 in accordance with the invention has centered a marine riser 12 in an opening 14 in a working deck 16 by means of four cam arm units 18–21. These cam arm units are pivotally supported on the deck and are pivoted from a retracted position, shown in FIG. 3, to the active position shown in FIGS. 1 and 2 by means of four rectilinear power devices 24–27. The units 18–21 can also be mounted on removable deck segments so the centralizer 10 can be used in another location on the working deck 16. The riser can be used for drilling and/or production and the deck can be, for example, a well deck.

The deck 16 can be part of a surface vessel used for subsea drilling and/or production and in all events comprises a support having a planar top surface 29. The opening 14 is shown in FIG. 1 as being octagonal with the cam arm units 18–21 being equally spaced around the opening. The marine riser 12 is in the form of a cylindrical pipe.

Figure 4:
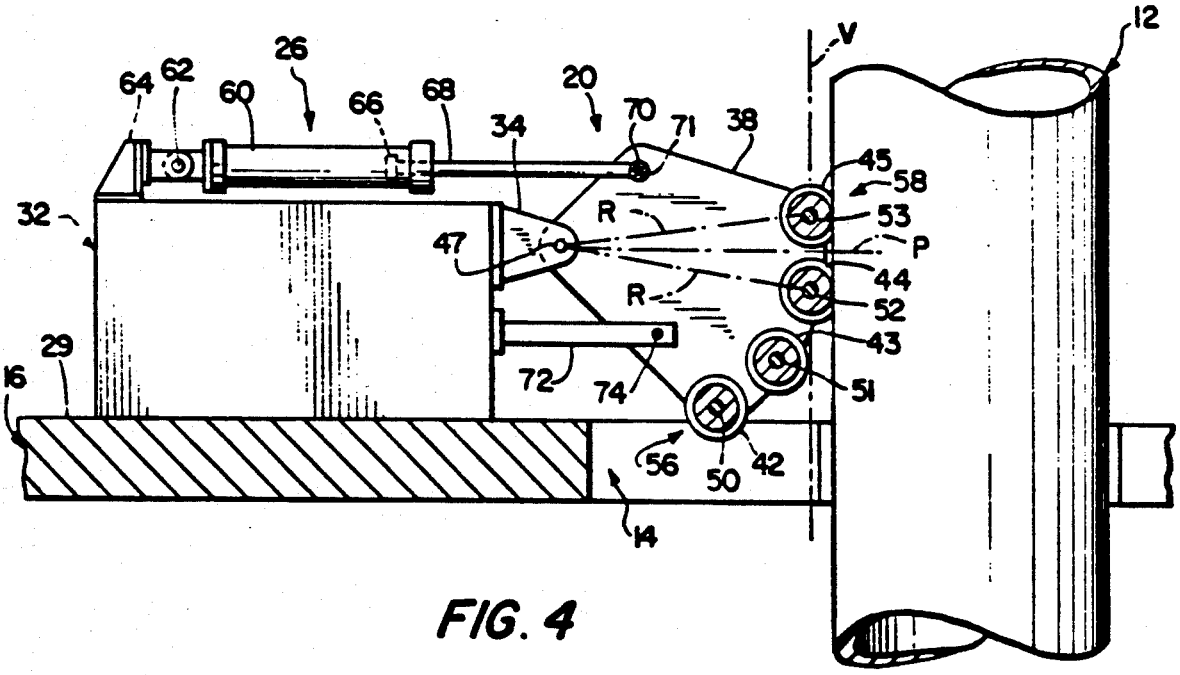
FIG. 4 is an enlarged elevational view in section taken along line 4—4 in FIG. 1 showing one of the cam arm units in the active position engaging the riser.

Since each of the cam arm units is the same, only one will be described in detail. Thus, as seen in FIG. 4, cam arm unit 20 comprises a support block 32 rigidly but removably coupled to the top surface 29 of the deck, a pair of trunnions 34 and 36 rigidly coupled to the support block and facing radially inwardly of the well deck towards the opening, a pair of parallel, substantially trapezoidal cam plates 38 and 40 pivotally coupled respectively to the trunnions, and first, second, third and fourth rollers 42–45 rotationally coupled between and to the cam plates. By removably coupling the support blocks to the well deck, such as by bolts, the centralizer assembly is easily relocated to other well decks.

Figure 3:
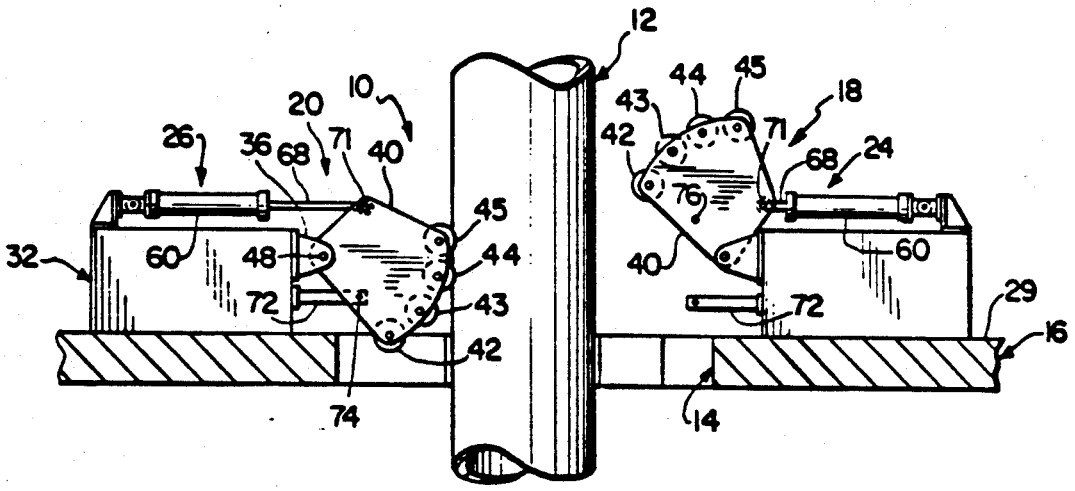
FIG. 3 is a side elevational view similar to that shown in FIG. 2 except that one of the cam arm units is in the retracted position.

Each of the cam plates 38 and 40 has suitable bores for the reception of horizontal shafts 47 and 48 seen in FIGS. 3 and 4 which also pass through the trunnions 34 and 36, these shafts being aligned, parallel to the planar top surface 29 of the deck and forming the pivot axis for the cam plates 38 and 40. Similarly, each of the rollers 42–45, which have concave outer surfaces, has a central bore for the reception of shafts 50–53, respectively, to form rotational axes therefor and for rotationally coupling the rollers to the cam plates 38 and 40, which have suitable bores therein for the reception of the shafts. As seen in FIG. 4, these shafts 50–53 are parallel to the pivot axis of the cam plates formed by shafts 47 and 48. As seen in FIG. 1, the cam plates 38 and 40 are parallel and as seen in FIG. 4, support the rollers 42–45 so that the outer surfaces thereof form a camming surface facing the opening 14. The first end 56 of the camming surface is formed by the outer surface of roller 42 and a second end 58 of this camming surface is defined by the outer surfaces of rollers 44 and 45. As seen in FIG. 4, the camming surface so defined increases in radius from the pivot axis of shafts 47 and 48 from the first end 56 to the second end 58. The shafts of the four rollers include an arc of a circle having a center point at shafts 47 and 48 of about 55°.

As seen in FIG. 4, the radii indicated by the phantom lines R emanating from the pivot axis of shafts 47 and 48 to the rotational axes 52 and 53 of the third and fourth rollers are the same. The horizontal plane P indicated by a phantom line, which is parallel to the planar top surface 29 of the working deck and receives the shafts 47 and 48 therein, is midway between the shafts 52 and 53 of the third and fourth rollers when they are in the active position. Thus, as seen in FIG. 4 in the active position the third and fourth rollers 44 and 45 both engage the riser 12 and the vertical phantom line V, which is parallel to the outside surface of the riser 12, passes through both of the roller shafts 52 and 53.

Each of the rectilinear power devices 24–27 is the same so only one will be described in detail. Thus, rectiliner power device 26 seen in FIG. 4 comprises a hydraulic cylinder 60 pivotally coupled in a substantially horizontal position via horizontal shaft 62 to a trunnion 64 rigidly coupled on the top of the support block 32, and a piston 66 slidably movable inside the cylinder and having a piston rod 68 coupled thereto and extending outwardly therefrom. This piston rod has a hollow bar 70 rigidly coupled horizontally and transversely at the end, the bar having a shaft 71 received therein and in suitable bores above and between shafts 47, 48 and shaft 53 in each of the cam plates 38 and 40 for a pivotal coupling therebetween.

A locking device in the form of a plate 72 is rigidly coupled to the radially inwardly facing side of the support block 32 below the trunnions 34 and 36 and extends between the cam plates 38 and 40, this plate having a suitable bore at the distal end for the reception of a horizontal, transverse locking pin 74 which is also received in suitable bores 76 in each cam plate 38 and 40. Thus, once the cam plates 38 and 40 are located in their active position shown in FIG. 4, pin 74 can be passed through the bores in the cam plates and the bore in the locking plate to lock the cam plates in that position.

Operation

As seen in FIGS. 1 and 2, the four cam arm units 18–21 have been pivoted into their active position in which the third and fourth rollers on each directly engage the outer surface of the riser 12 to center the riser in the opening 14 in the working deck. The lateral forces of the riser tending to move it away from such centered position are thus resisted by the rollers, cam plates, trunnions and support blocks which are rigidly coupled to the deck.

This active position is established by moving the cam arm units, such as cam arm unit 18 seen in FIG. 3, from the retracted position in which it is spaced away from the riser through a vertical plane perpendicular to the top planar surface 29 of the deck by means of the rectilinear power devices 24–27. This is accomplished by extension of the hydraulic piston rods 68 in each of the hydraulic cylinders 60 with the cam plates 38 and 40 pivoting relative to the piston rods via shafts 71 and relative to the trunnions 34 and 36 by means of pivot shafts 47 and 48. Preferably, all of the four cam arm units are moved from their retracted position to the active position at the same time. Once all four of the cam arm units are in the active position shown in FIGS. 1 and 2, the locking pins 74 can be used to lock the cam arm units in this position.

While one advantageous embodiment has been chosen to illustrate the invention, it will be understood by those skilled in the art that various changes and modifications can be made therein without departing from the scope of the invention as defined in the appended claims.

What is claimed is:

1. A centralizer assembly for centering a pipe in an opening in a support, the combination comprising:

a plurality of support blocks equally spaced around the opening and rigidly coupled to the top, substantially planar surface of the support;

a plurality of cam units, each pivotally coupled to one of said support blocks for pivotal movement about a pivot axis parallel to the plane containing the top surface of the support, each of said cam units including a camming surface facing radially inwardly towards the longitudinal axis of the opening for engaging the pipe, said camming surface increasing in radius from said pivot axis from a first end towards a second end; and power means, coupled to each of said support blocks and cam units, for pivoting each of said cam units from a retracted position spaced away from the pipe located in the opening to an active position wherein said larger radii second end of said camming surface engages the pipe, said camming surfaces included in each of said cam units each comprising the surfaces of a plurality of rollers rotationally coupled to each of said cam units about axes parallel to the pivot axes of the cam units associated therewith.

2. A centralizer assembly according to claim 1, wherein two rollers are located at said camming surface second end, their rotational axes having substantially the same radii from the pivot axis associated therewith.

3. A centralizer assembly according to claim 2, wherein a plane parallel to the top surface of the support and passing through said pivot axis is midway between the rotational axes of said two rollers located at said camming surface second end.

4. A centralizer assembly according to claim 1, wherein said plurality of rollers comprises at least three rollers, and the rotational axes of said rollers increase in radius from said pivot axis from said first end to said second end except for the last two rollers which have equal radii from said pivot axis.

5. A centralizer assembly according to claim 1, wherein each of said rollers has a concave outer surface.

6. A centralizer assembly according to claim 1, wherein said camming surface comprises four rollers.

7. A centralizer assembly according to claim 1, wherein said plurality of rollers comprises at least three rollers, and the rotational axes of said rollers define an arc of a circle having its center at said pivot axis of about 55°.

8. A centralizer assembly according to claim 1, wherein said power means includes a rectilinear power device.

9. A centralizer assembly according to claim 8, wherein said rectilinear power device comprises a hydraulic cylinder.

10. A centralizer assembly according to claim 8, wherein said rectilinear power device is pivotally coupled to each of said support blocks and said cam units.

11. A centralizer assembly according to claim 1, wherein each of said cam units comprises a pair of parallel plates.

12. A centralizer assembly according to claim 1, and further comprising means, coupled to said support, for engaging and locking each of said cam units in the active position.

13. A centralizer assembly according to claim 1, wherein the pipe is a marine riser, and the support is a portion of a working deck.

* * * * *